US010974508B2

(12) United States Patent
Giusti et al.

(10) Patent No.: US 10,974,508 B2
(45) Date of Patent: Apr. 13, 2021

(54) FLUID EJECTION DEVICE WITH PIEZOELECTRIC ACTUATOR AND MANUFACTURING PROCESS THEREOF

(71) Applicant: STMICROELECTRONICS S.R.L., Agrate Brianza (IT)

(72) Inventors: Domenico Giusti, Caponago (IT); Marco Ferrera, Concorezzo (IT); Carlo Luigi Prelini, Seveso (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 0 days.

(21) Appl. No.: 16/392,007

(22) Filed: Apr. 23, 2019

(65) Prior Publication Data

US 2019/0329551 A1 Oct. 31, 2019

(30) Foreign Application Priority Data

Apr. 27, 2018 (IT) ..... 102018000004935

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1606* (2013.01); *B41J 2/1631* (2013.01); *B41J 2/1645* (2013.01); *B41J 2002/14241* (2013.01); *B41J 2002/14491* (2013.01)

(58) Field of Classification Search
CPC ..... B41J 2/14233; B41J 2002/14491; B41J 2002/14241; B41J 2/1606
See application file for complete search history.

(56) References Cited

U.S. PATENT DOCUMENTS 6,447,106 B1 9/2002 Watanabe et al.
7,559,631 B2 * 7/2009 Shimada ..... B41J 2/14233 347/64
8,633,553 B2 1/2014 Ferrera et al.
2012/0167823 A1 7/2012 Gardner et al.
2013/0027477 A1 * 1/2013 Guan ..... B41J 2/1646 347/71
2014/0313264 A1 10/2014 Cattaneo et al.
2016/0236470 A1 8/2016 Mizukami
2016/0351788 A1 12/2016 Mizukami

OTHER PUBLICATIONS

Takahashi, "Adaptability of Piezoelectric Inkjet Head," NIP17: International Conference on Digital Printing Technologies, Sep. 30-Oct. 5, 2001, pp. 323-327.
"Packaging Products from Dow Corning—Low Stress Patternable Silicones", Electronics Solutions, Dow Corning, 2006, 2 pages.

* cited by examiner

*Primary Examiner* — Geoffrey S Mruk
(74) *Attorney, Agent, or Firm* — Seed Intellectual Property Law Group LLP

(57) ABSTRACT

A fluid ejection device, comprising: a chamber; a membrane, with a first side and a second side opposite to one another, where the first side faces the chamber; an actuator, of a piezoelectric type, which extends on the second side of the membrane and is operatively coupled to the membrane for causing, in use, a vibration of the membrane; a passivation layer, which extends only alongside, or partially on, the actuator; and a protection layer, which extends on the actuator at least in surface portions of the latter that are free from the passivation layer, and has a Young's modulus lower than the Young's modulus of the passivation layer.

22 Claims, 7 Drawing Sheets

FLUID EJECTION DEVICE WITH PIEZOELECTRIC ACTUATOR AND MANUFACTURING PROCESS THEREOF

BACKGROUND

Technical Field

The present disclosure relates to a fluid ejection device and to a manufacturing process thereof.

Description of the Related Art

Known to the prior art are multiple types of fluid ejection devices, which can be used in printing applications, in particular in the context of ink-jet printheads. Printheads of this sort, with appropriate modifications, may likewise be used for the ejection of fluids other than ink, for example for applications in the biological or biomedical field, for local application of biological material (e.g., DNA) in the production of sensors for biological analyses, for decoration of fabrics or ceramics, and in 3D-printing and additive-manufacturing applications.

Known manufacturing methods envisage coupling via bonding of at least three pre-processed wafers, i.e., a first wafer housing an actuator (for example, a piezoelectric actuator), a second wafer that has a fluid ejection nozzle, and a third wafer including an inlet hole for the fluid to be ejected. Reference may, for example, be made to U.S. Pat. Pub. No. 2014/0313264, which is incorporated herein.

FIG. 1 shows, in a triaxial orthogonal system X, Y, Z, a portion of the first wafer, according to an embodiment of known type, housing a single piezoelectric actuator 3 and defining at least in part a chamber 10 for containing the fluid to be ejected. The first wafer further has an inlet channel 14 that forms part of the inlet hole for intake of the fluid from a tank (not illustrated) towards the chamber 10.

The first wafer (designated by the reference number 1) comprises a substrate 11, of semiconductor material (e.g., silicon, Si), extending over which is a membrane 7, delimited by a first side 7*a* and a second side 7*b* opposite to one another in the direction of the axis Z, and suspended over the chamber 10. In particular, the first side of the membrane 7*a* directly faces the chamber 10. The membrane 7 has, for example, in top plan view (not illustrated) a quadrangular shape (e.g., rectangular, or rectangular with rounded corners) with a main extension (major side) parallel to the axis Y and a secondary extension (minor side) parallel to the axis X. The membrane 7 is formed, for example, by a stack of $SiO_2$-polysilicon-$SiO_2$. In particular, the $SiO_2$ layers have a thickness, for example, of between 0.1 μm and 2 μm, and the polysilicon layer (grown epitaxially) has a thickness, for example, of between 1 μm and 20 μm. In various embodiments, the membrane 7 may be made of other materials typically used for MEMS devices, for example $SiO_2$ (silicon oxide) or else SiN (silicon nitride), having a thickness of between 0.5 μm and 10 μm, or else by a stack in various combinations of $SiO_2$—Si—SiN.

Extending on the membrane 7, in particular on the second face 7*b*, is a bottom electrode 19, forming part of a piezoelectric actuator 3, coupled to the membrane 7; for example, the bottom electrode 19 is formed by a stack of $TiO_2$—Pt, where the layer of $TiO_2$ (titanium oxide) has, for example, a thickness of between 5 nm and 50 nm, and the layer of Pt (platinum) has a thickness of between 30 nm and 300 nm.

Extending on the bottom electrode 19 is a piezoelectric region 16, comprising a layer of PZT (Pb, Zr, $TiO_3$), having a thickness of between 0.5 μm and 5.0 μm, more typically 1 μm or 2 μm. Extending on the piezoelectric region 16 is a top electrode 18, for example of Pt (platinum), or Ir (iridium), or $IrO_2$ (iridium oxide), or TiW (titanium/tungsten alloy), or Ru (ruthenium), having a thickness of between 30 nm and 300 nm.

The piezoelectric actuator 3 further comprises an insulating layer 17, which extends on the bottom electrode 19, the piezoelectric region 16, and the top electrode 18. The insulating layer 17 includes dielectric materials used for electrical insulation, for example, layers of $SiO_2$ or SiN or $Al_2O_3$ (aluminium oxide), either single or in stacks superimposed on top of one another, having a thickness of between 10 nm and 1 μm.

Conductive paths 23, 25 extend on the insulating layer 17 and contact the bottom electrode 19 and the top electrode 18, respectively, enabling selective access to the top electrode 18 and to the bottom electrode 19 so as to bias them electrically when in use. For instance, the conductive paths 23, 25 are made of aluminium (Al).

A passivation layer 27 extends on the insulating layer 17, the top electrode 18, and the conductive paths 23, 25. The passivation layer 27 includes dielectric materials used for passivation of the piezoelectric actuator 3, for example, layers of SiN or SION (silicon oxynitrate) or $AlO_3$, either single or stacked on top of one another, having a thickness of between 0.1 μm and 0.5 μm.

Conductive pads 21 are likewise formed alongside the piezoelectric actuator 3 and are electrically coupled to the conductive paths 23, 25.

The piezoelectric region 16 is particularly sensitive to the humidity of the environment in which it operates, in particular when used in fluid ejection devices. For this reason, the passivation layer 27 completely extends over the piezoelectric region 16 and likewise has the function of forming a barrier against humidity.

However, the above known solution has some disadvantages, in so far as it adversely affects the efficiency of the membrane 7, in particular its capacity to undergo deformation following upon the action of the piezoelectric actuator 3. These disadvantages are all the more felt if it is considered that the piezoelectric actuator 3 is a fundamental component of the fluid ejection device 1 and that, typically, each fluid ejection device includes a plurality of piezoelectric actuators 3 simultaneously governed for ejecting, each, the same volume of liquid.

The Applicant has verified that the presence of the passivation layer 27 on the piezoelectric region 16 interferes with the capacity of deformation of the piezoelectric region 16, and hence of the membrane 7, due to a high value of the Young's modulus, of the intrinsic compressive stress, as well as of a low value of Poisson's ratio (typically, 0.2), of the materials used for the passivation layer 27. In other words, the passivation layer 27 stiffens the membrane 7, limiting the deformation capabilities when in use.

There is thus the need to provide a solution to the disadvantages set forth above.

BRIEF SUMMARY

Embodiments of the present disclosure are directed to a fluid ejection device and a manufacturing process thereof. In at least one embodiment, the fluid ejection device comprises a piezoelectric actuator with a low stress protection layer.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 2:
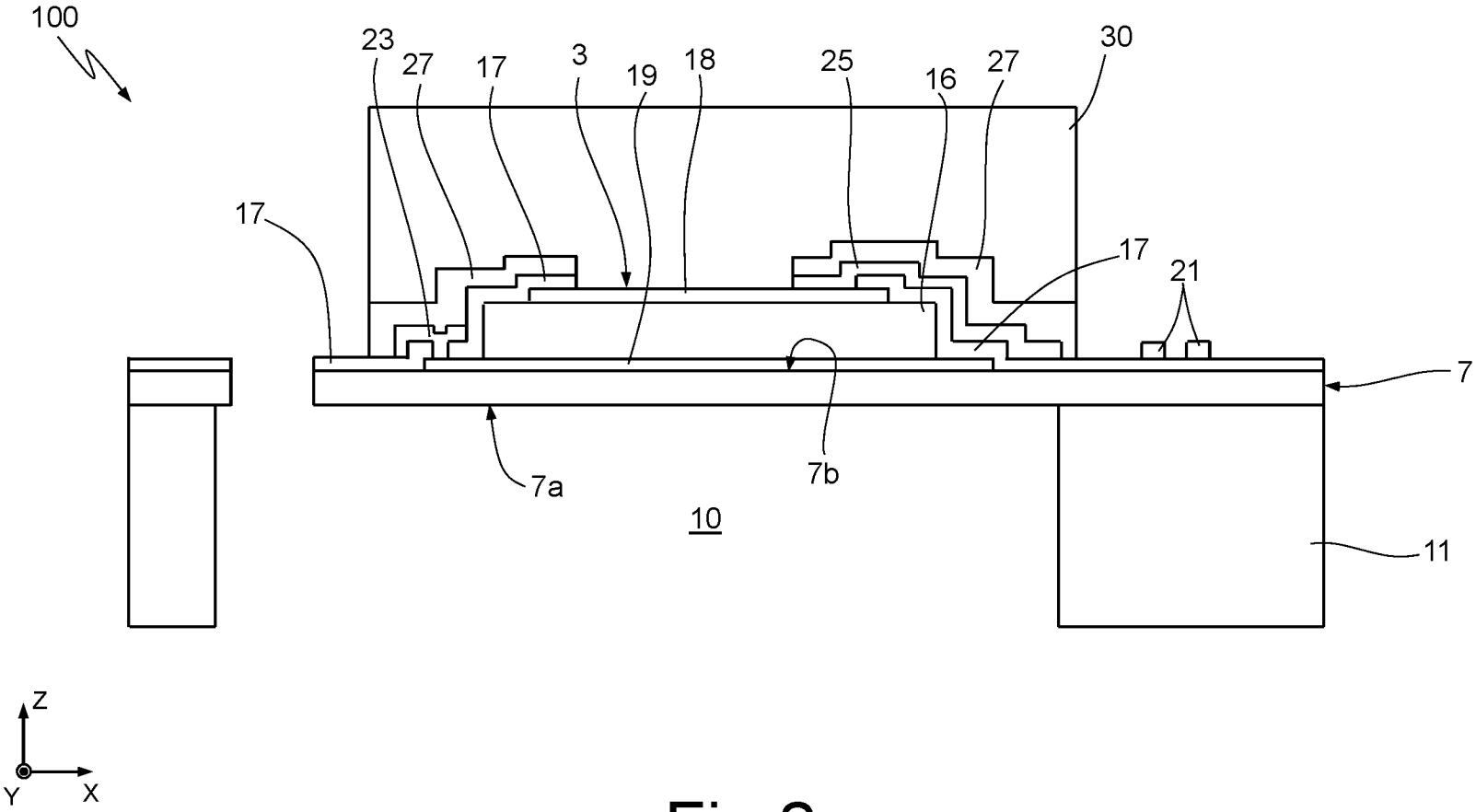
FIG. 2 is a cross-sectional view of a portion of a wafer, comprising a single piezoelectric actuator, of a fluid ejection device according to an embodiment of the present disclosure.

FIG. 2 shows in a triaxial cartesian reference system X, Y, Z, a cross-sectional view of a portion of a first wafer 100, comprising a single piezoelectric actuator 3, according to an embodiment of the present disclosure.

As better described hereinafter and illustrated in FIG. 3, the first wafer 100 of FIG. 2 is part of a fluid ejection device.

Figure 1:
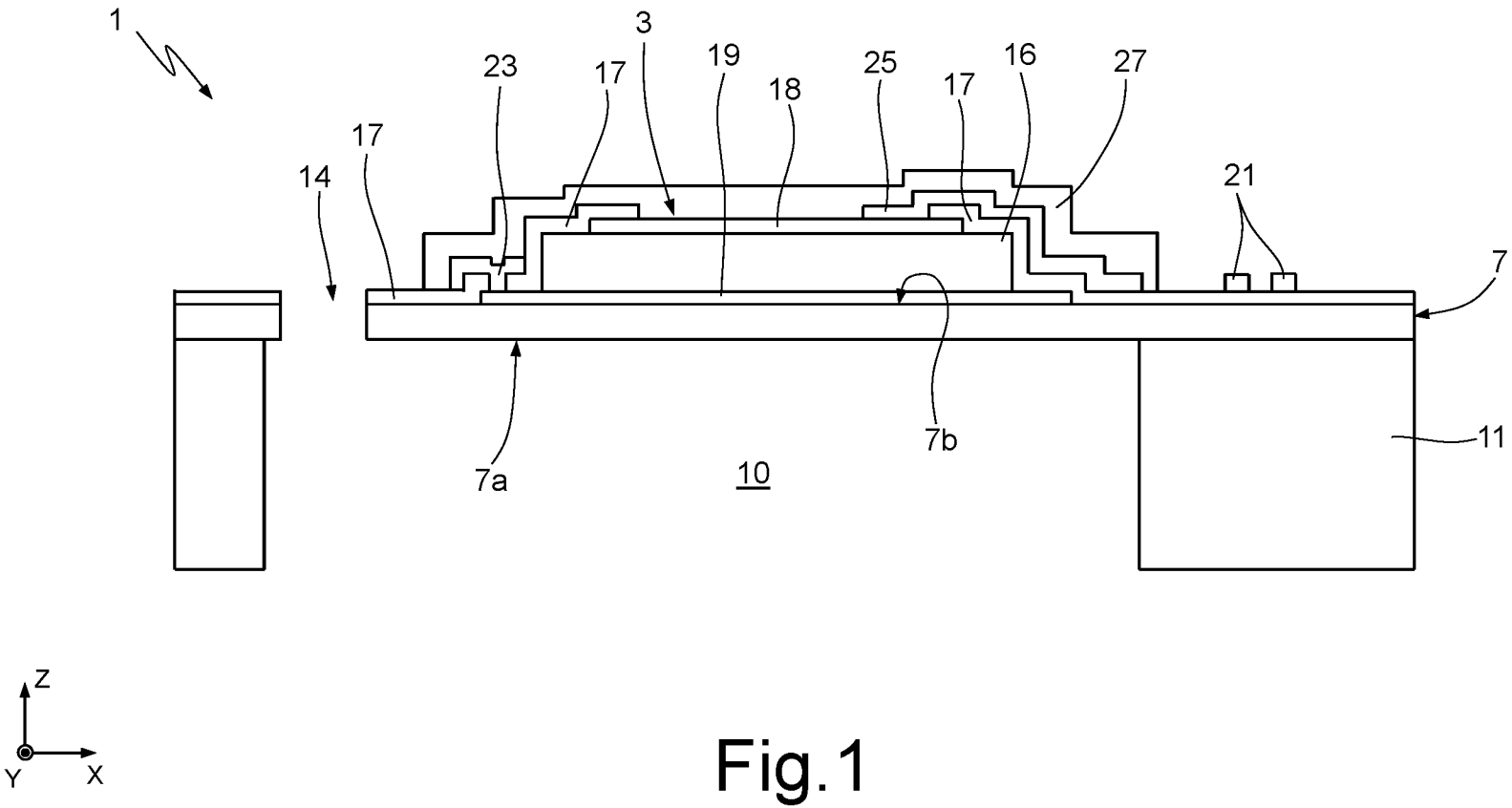
Fig.1 (Prior Art)
FIG. 1 shows a portion of a wafer, housing a single piezoelectric actuator, of a fluid ejection device according to an embodiment of a known type.

Technical characteristics of FIG. 2 corresponding to respective technical characteristics of FIG. 1 are designated in FIG. 2 by the same reference numbers and are not described further in the interest of brevity. Technical characteristics include structure and function of various components of the devices.

In FIG. 2, the passivation layer 27 extends as a protection of the conductive paths 23, 25 (in particular, a protection from humidity), and only partially on the piezoelectric actuator 3. In other words, the passivation layer 27 exposes in part the piezoelectric region 16 and/or the top electrode 18, such as at central portions of the piezoelectric region 16 and the top electrode 18.

According to an aspect of the present disclosure, a protection layer 30, for example with a thickness of between 1 μm and 150 μm, extends over the piezoelectric actuator 3, in particular on the portion of the piezoelectric region 16 and/or of the top electrode 18 that is exposed, i.e., not covered by the passivation layer 27. In at least one embodiment, the protection layer 30 extends completely over the piezoelectric actuator 3.

The protection layer 30 is made of a material having a Young's modulus of a value lower than the Young's modulus of the passivation layer 27. For instance, materials used in the prior art for the passivation layer 27 have a Young's modulus higher than 70 GPa. The protection layer 30 has a Young's modulus lower than the value indicated for the passivation layer 27, in particular between 0.05 MPa and 500 MPa, preferably lower than 10 MPa. Moreover, the protection layer 30 is made of a material having a Poisson's ratio higher than the Poisson's ratio of the passivation layer 27; for example, the protection layer 30 has a Poisson's ratio higher than 0.35 (i.e., with a lower tendency to undergo compression).

According to an aspect of the present disclosure, the protection layer 30 is made of an organic material or of a material with hybrid inorganic-organic structure, such as silicone or other silicone-based materials with an organic or hybrid inorganic-organic structure. The Applicant has verified that the aforementioned materials enable protection from humidity of the piezoelectric actuator 3, without significantly interfering with the deformation capabilities of the piezoelectric region 16 and, hence, of the membrane 7.

In any case, the presence of humidity outside the protection layer 30 does not cause oxidation of the conductive paths 23, 25 since the latter are protected by the passivation layer 27.

The protection layer 30 is chosen, in one embodiment, not only on the basis of the low value of intrinsic stress (low Young's modulus) and of the high value of the Poisson's ratio, but also on the basis of the low percentage of absorption of humidity, in particular lower than 0.2 wt %, preferably lower than 0.1 wt %.

According to one aspect of the present disclosure, the protection layer 30 is deposited by means of techniques of spin-coating deposition in a way in itself known, as well as defined by means of known photolithographic definition techniques (see, for example, the product "Photopatternable Spin-On Silicone" manufactured by Dow Corning). Alternatively, the protection layer 30 is deposited by means of printing techniques (see, for example, the product "Printable Silicone" manufactured by Dow Corning).

Figure 3:
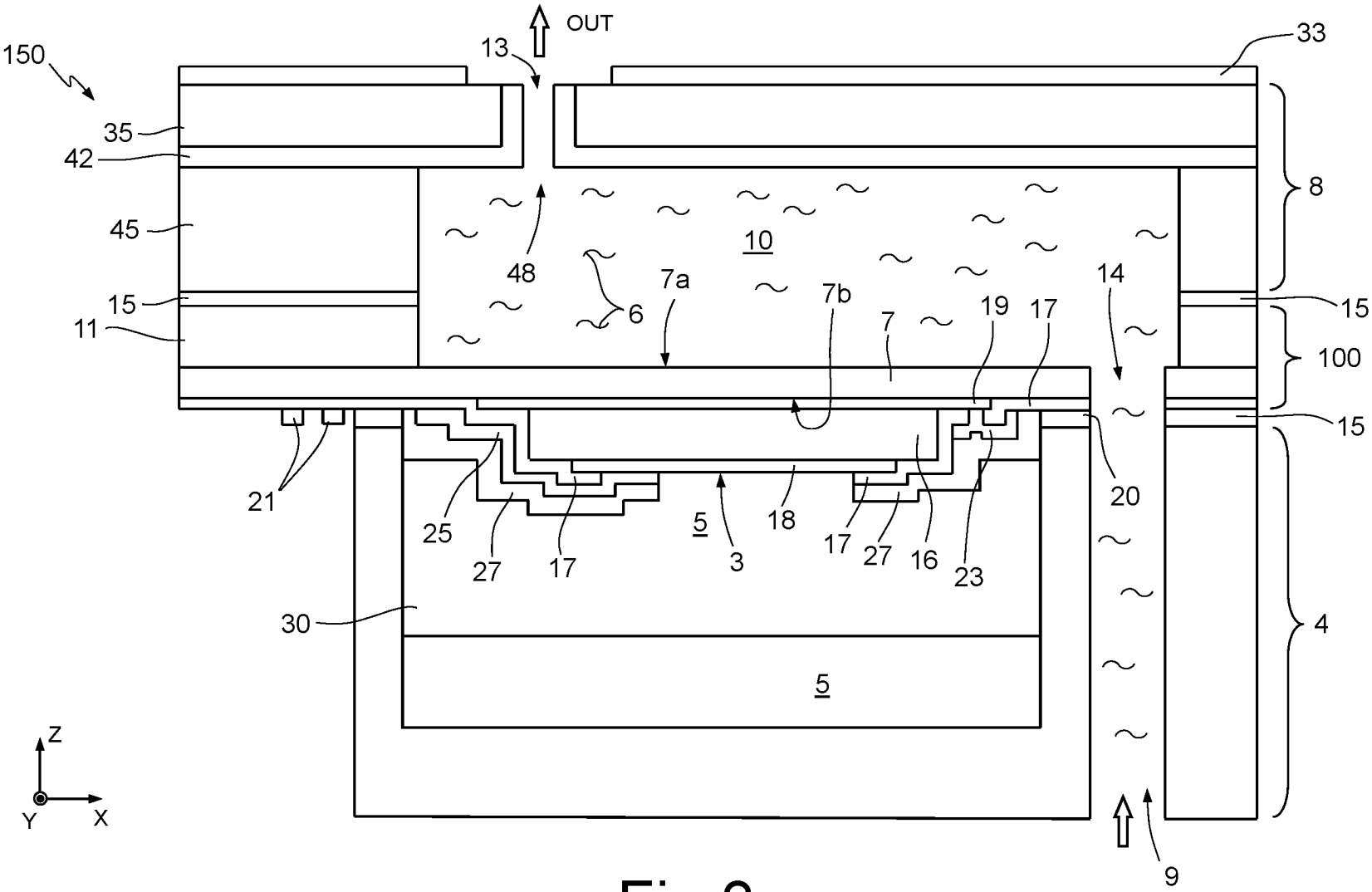
FIG. 3 is a cross-sectional view of the fluid ejection device comprising the first wafer of FIG. 2, in a first operating condition.

FIG. 3 is a cross-sectional view of a fluid ejection device 150, comprising the first wafer 100 and a second wafer 4 and a third wafer 8.

The second wafer 4 defines at least one containment chamber 5 for the piezoelectric actuator 3 configured to insulate, in use, the piezoelectric actuator 3 by the fluid 6 to be expelled, and further has at least one inlet channel 9 for the fluid 6, in fluidic connection with the chamber 10.

The third wafer 8 includes a body (designated by the references 35 and 45), made, for example, of polysilicon, and at least one channel 13 for expulsion of the fluid 6 (ejection nozzle), formed in part through the polysilicon body, provided with a hydrophilic region 42 (made, for example, of $SiO_2$), and configured to place the chamber 10 in fluidic communication with an environment external to the fluid ejection device 150.

The aforementioned wafers 100, 4, 8 are coupled together by means of interface thermally joined regions, and/or bonding regions, and/or gluing regions, and/or adhesive regions, for example made of polymeric material, designated as a whole by the reference number 15 in FIG. 3.

FIG. 3 illustrates a first operating step of the fluid ejection device 150, in which the chamber 10 is filled with a fluid 6 that is to be ejected. This step of loading the fluid 6 is carried out through the inlet channel 9.

Figure 4:
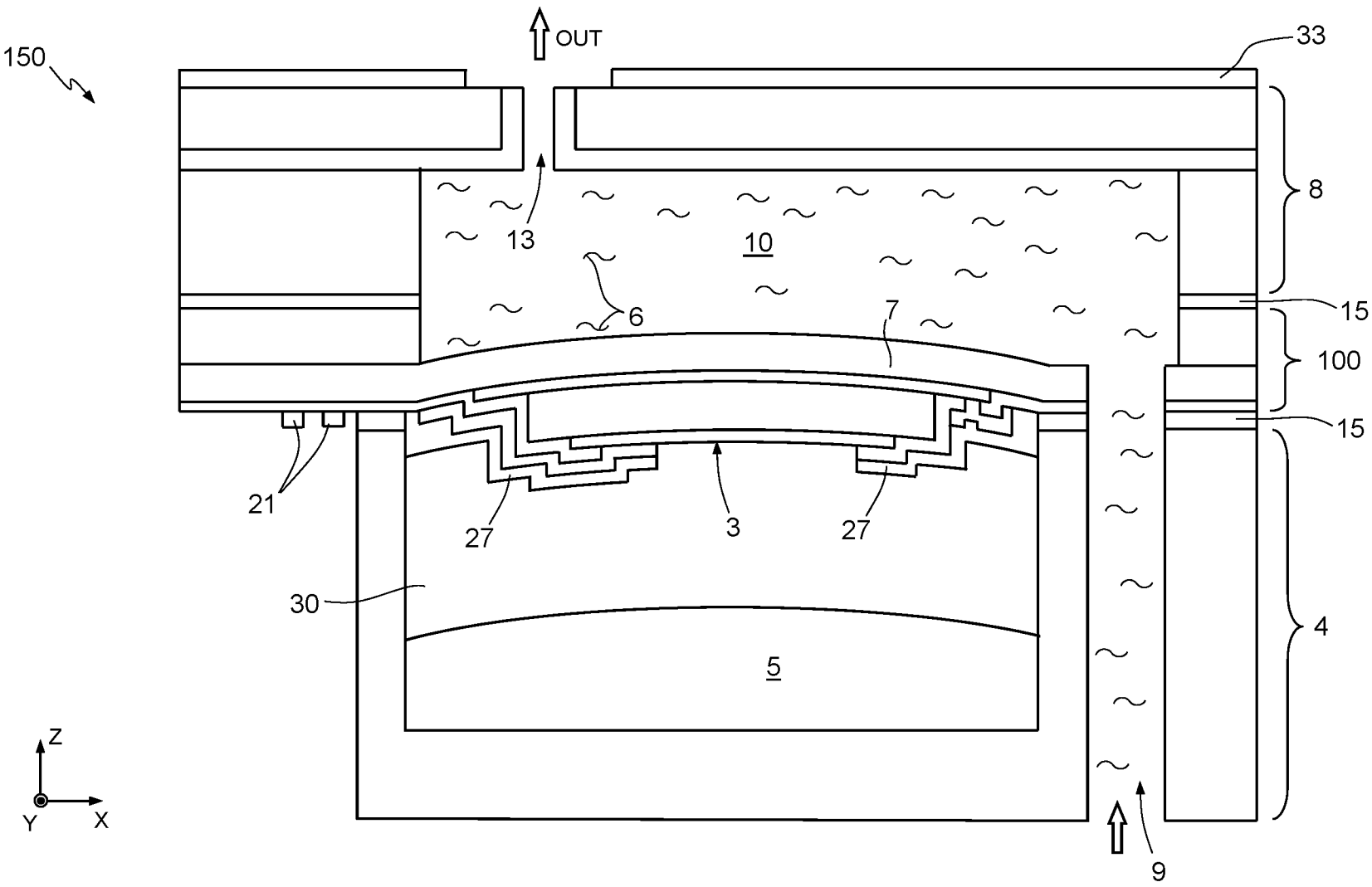
FIGS. 4 and 5 show the fluid ejection device of FIG. 3 in further operating conditions.
Figure 5:
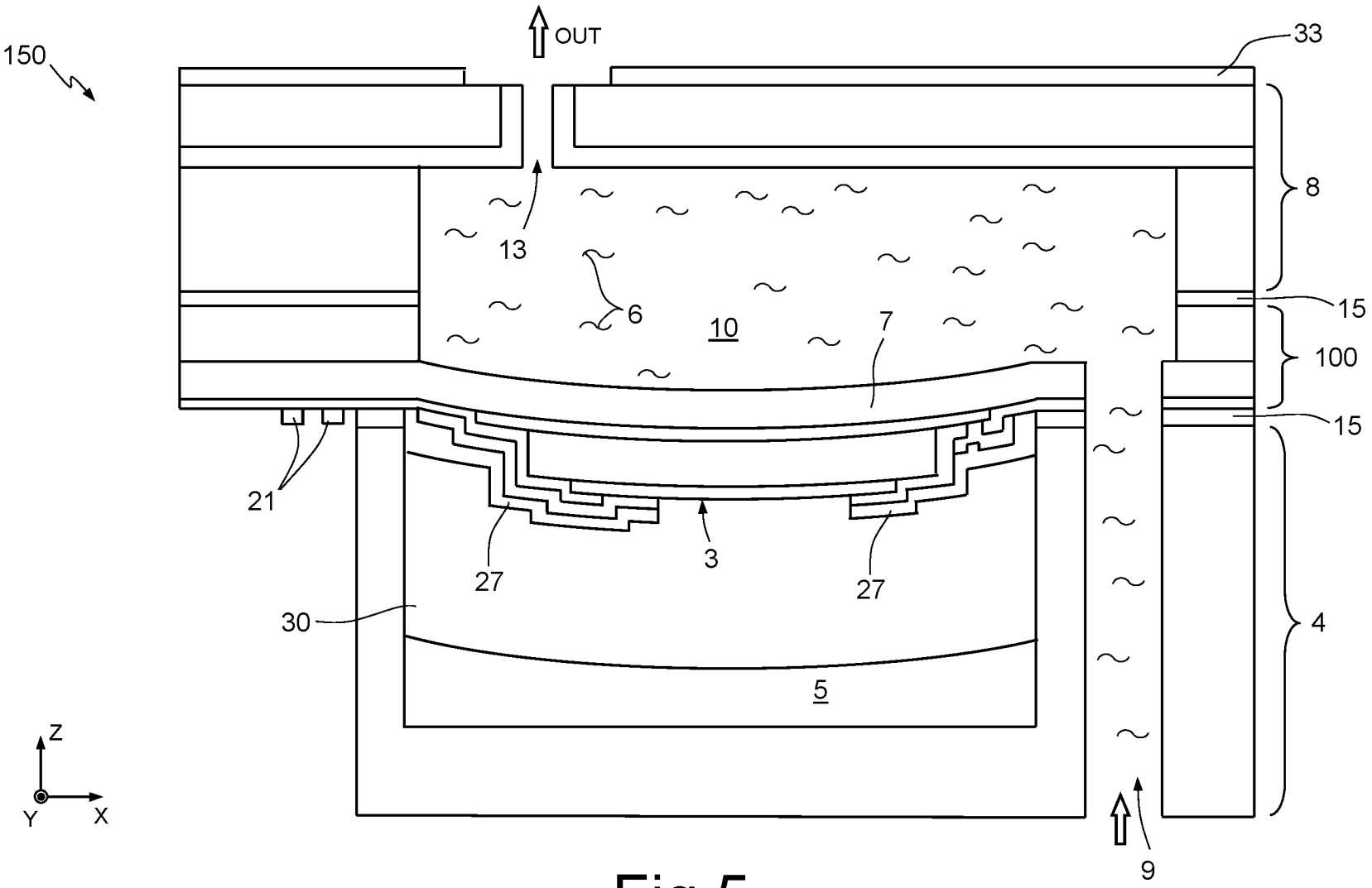

FIGS. 4-5 show the fluid ejection device 150 in further operating steps, during use.

With reference to FIG. 4, the piezoelectric actuator 3 is governed through the top and bottom electrodes 18 and 19 (which are biased by means of the conductive paths 23, 25) so as to generate a deflection of the membrane 7 towards the inside of the chamber 10. Said deflection causes a movement of the fluid 6, which, from the chamber 10, passes directly (i.e., without intermediate channels) into the nozzle 13, with consequent controlled expulsion of a drop of fluid 6 towards the outside of the fluid ejection device 150.

Then, with reference to FIG. 5, the piezoelectric actuator 3 is governed through the top and bottom electrodes 18 and 19 so as to generate a deflection of the membrane 7 in a direction opposite to the one illustrated in FIG. 4, so as to increase the volume of the chamber 10, recalling further fluid 6 towards the chamber 10 through the inlet channel 9. The chamber 10 is hence filled again with fluid 6. It is then possible to cyclically proceed by driving the piezoelectric actuator 3 for expulsion of further drops of fluid. The steps of FIGS. 4 and 5 are thus repeated for the entire printing process.

Driving of the piezoelectric element by biasing the top and bottom electrodes 18, 19 is in itself known and is not described in detail herein.

Figure 6:
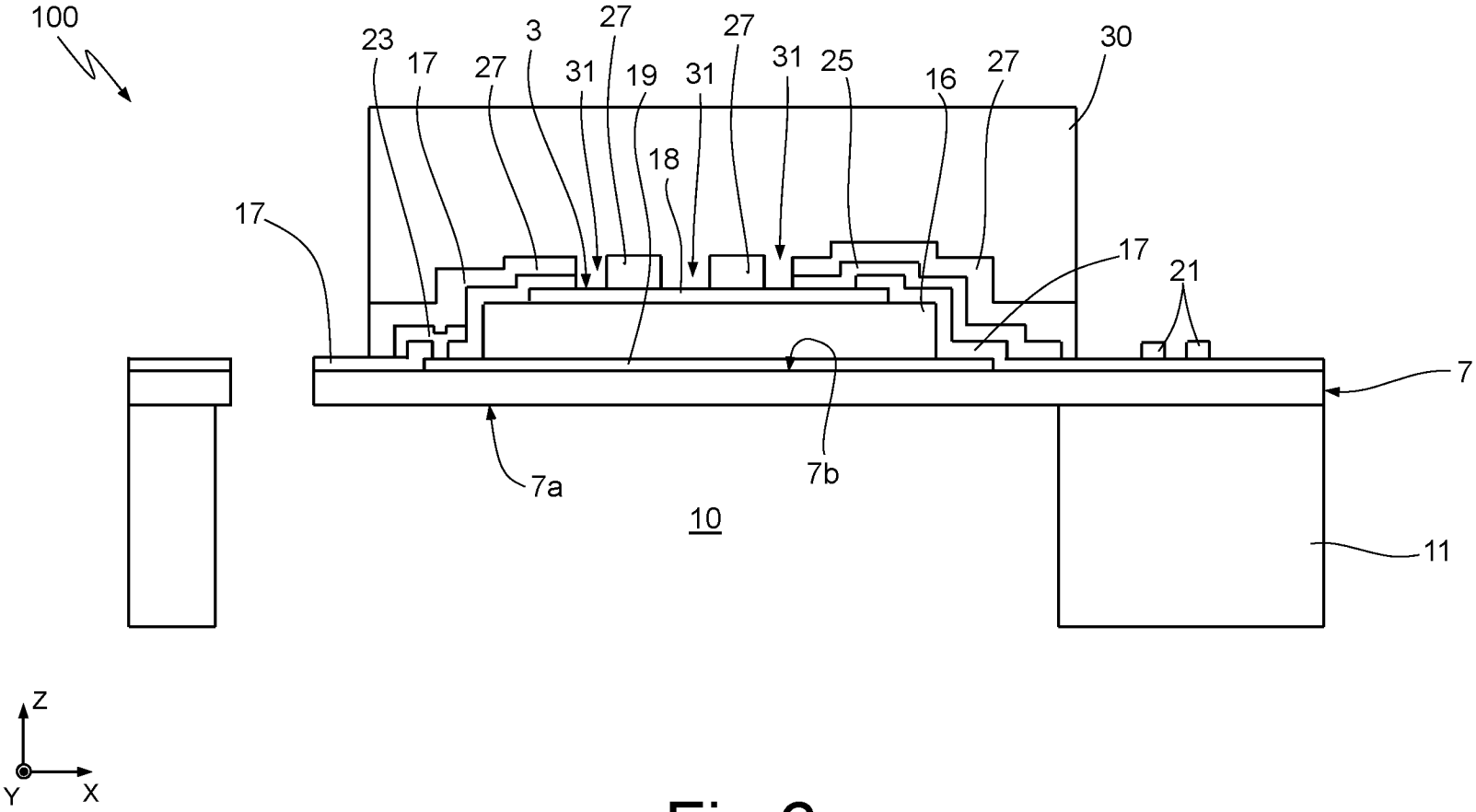
FIG. 6 is a cross-sectional view of a portion of a wafer, comprising a single piezoelectric actuator, according to an embodiment alternative to the embodiment of FIG. 2.

FIG. 6 is a cross-sectional view of an embodiment of the first wafer 100 alternative to the embodiment of the first wafer 100 of FIG. 2. In particular, elements corresponding to the ones illustrated in FIG. 2 are designated in FIG. 6 by the same reference numbers and will not be described any further.

The passivation layer 27 is here patterned so as to form a plurality of openings 31, which expose selective portions of the top electrode 18. The protection layer 30 extends over the piezoelectric actuator 3 and over the passivation layer 27, as well as in the exposed portions of the electrode 18, through the plurality of openings 31.

Figure 7:
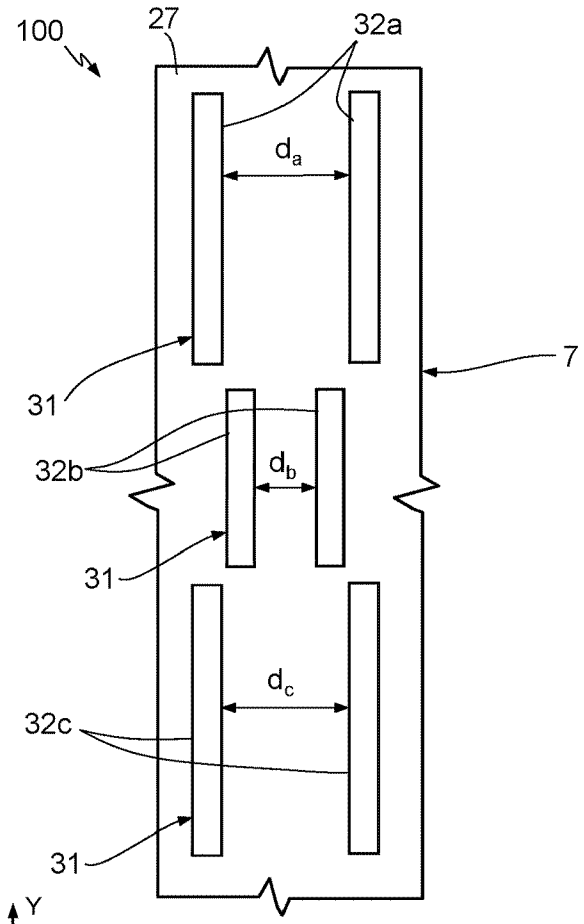
FIGS. 7-9 are top plan views of respective layouts of a portion of the wafer of FIG. 6.
Figure 8:
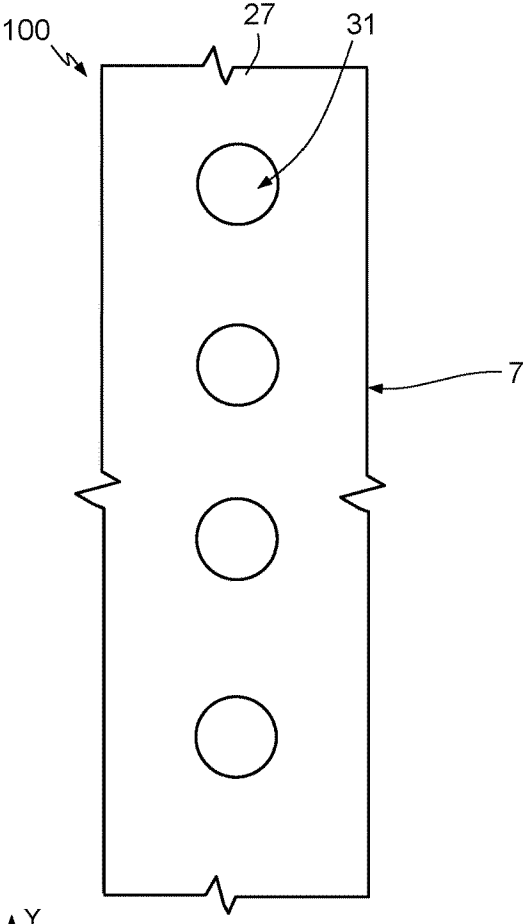
Figure 9:
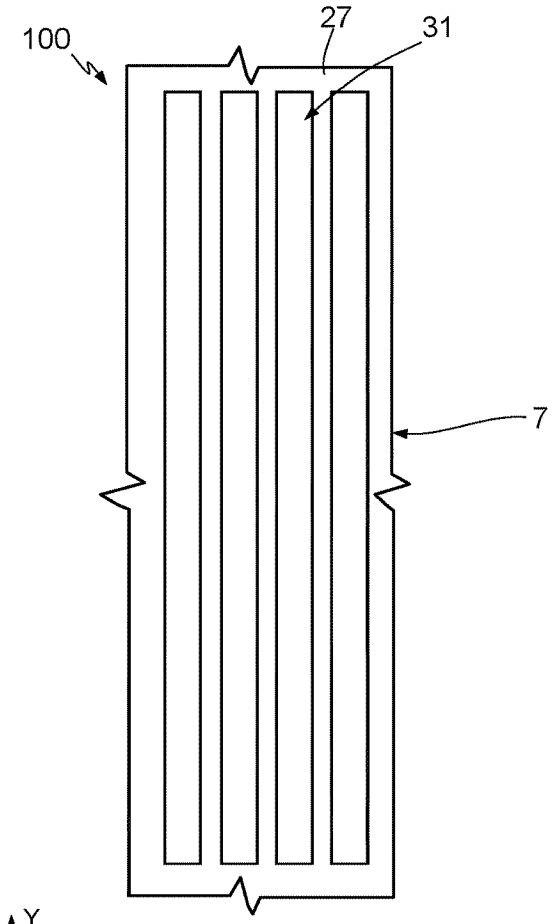

FIGS. 7-9 show, in top plan view, respective layouts of a portion of the first wafer 100; in particular, in each of the embodiments of FIGS. 7-9, the first wafer 100 is illustrated in top plan view on the plane XY, and only the elements fundamental for an understanding of the respective embodiment are illustrated. Moreover, elements corresponding to the ones illustrated in FIG. 6 are designated in FIGS. 7-9 by the same reference numbers.

With reference to FIG. 7, the plurality of openings 31 here comprises three sets 32*a*-32*c* of openings 31; each opening 31 has a polygonal shape (in particular, rectangular, or rectangular with rounded corners) with main extension parallel to the axis Y, as well as to the direction of main extension of the membrane 7. In particular, the set 32*a* comprises two openings 31 separated from one another, along the axis X, by a distance $d_a$. Likewise, also the set 32*c* comprises two openings 31 separated from one another, along the axis X, by a distance $d_c$ that, in this example, is equal to $d_a$. The set 32*b* is positioned between the set 32*a* and the set 32*c* and comprises two openings 31 separated from one another, along the axis X, by a distance $d_b<d_a$. It is evident that each set 32*a*-32*c* may comprise any number of openings 31, separated from one another along X by respective distances of a value freely chosen.

FIG. 8 shows a different layout of the first wafer 100, in which the openings 31 have a circular shape and are aligned to one another along the axis Y, as well as along the direction of main extension of the membrane 7. In particular, the openings 31 are spaced at equal distances apart from one another.

FIG. 9 shows a further layout in which the openings 31 have a rectangular shape, with respective main extension along the axis Y and are hence parallel to one another. In particular, the main extension of the openings 31 follows the extension of the piezoelectric region 16, as well as of the membrane 7.

The embodiments of FIGS. 7 and 9 enable reduction of the stiffness of the membrane 7 in the direction of the axis X, whereas along the axis Y the membrane 7 is stiffer, hence optimising deflection of the membrane 7 along the axis Z.

From an examination of the characteristics of the disclosure provided according to the present disclosure the advantages that it affords are evident.

In particular, the protection layer 30, with low Young's modulus and low intrinsic stress, enables protection of the piezoelectric actuator 3 from humidity, without interfering with the deformation capabilities of the piezoelectric region 16 and, hence, of the membrane 7.

Moreover, the protection layer 30, with low stress, does not have a significant impact upon the capacity of deformation of the piezoelectric actuator 3, and hence enables an optimisation of the electric power consumption.

In addition, the use of a material with low intrinsic stress for the protection layer 30 allows, in the manufacturing stage and in the presence of possible process spread, to neglect any contributions of intrinsic stress due to the aforesaid process spread (e.g., 10% of intrinsic stress more).

Moreover, since the protection layer 30 is made of polymeric material, it has a greater chemical resistance to both acid and basic type inks.

Finally, it is clear that modifications and variations may be made to what has been described and illustrated herein, without thereby departing from the sphere of protection of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluid ejection device, comprising:

a chamber configured to contain a fluid to be ejected;

a membrane having a first side and a second side opposite the first side, the first side facing the chamber;

a piezoelectric actuator at the second side of the membrane and operatively coupled to the membrane for causing, in use, a vibration of the membrane, a passivation layer at least partially on the piezoelectric actuator such that a portion of the piezoelectric actuator remains exposed from the passivation layer; and a protection layer abutting the portion of the piezoelectric actuator that remains exposed from the passivation layer, the protective layer having a Young's modulus that is lower than a Young's modulus of the passivation layer.

2. The device according to claim 1, wherein the protection layer has a percentage of absorption of humidity equal to or less than 0.2 wt %.

3. The device according to claim 1, wherein the protection layer is made of an organic material or a material with hybrid inorganic-organic structure.

4. The device according to claim 1, wherein the protection layer is made of photopatternable or printable silicone.

5. The device according to claim 1, wherein the Young's modulus of the protection layer is between 0.05 MPa and 500 MPa.

6. The device according to claim 1, wherein the protection layer has a Poisson's ratio higher than or equal to 0.35.

7. The device according to claim 1, wherein the protection layer has a thickness of between 1 μm and 150 μm.

8. The device according to claim 1, wherein the piezoelectric actuator comprises:

a bottom electrode;

a piezoelectric region made of PZT on the bottom electrode;

a top electrode on the piezoelectric region;

a first conductive path electrically coupled to the bottom electrode; and a second conductive path electrically coupled to a first surface portion of the top electrode, wherein a second surface portion of the top electrode is exposed, wherein the passivation layer is on the first and second conductive paths, and wherein the protection layer is on the second surface portion of the top electrode.

9. The device according to claim 8, the passivation layer includes a plurality of openings exposing a plurality of portions of the top electrode, respectively.

10. The device according to claim 9, wherein the plurality of openings have, in top plan view, a respective shape chosen from circular, oval, polygonal, and polygonal with rounded corners.

11. The device according to claim 10, wherein the plurality of openings are arranged in pairs, wherein a distance between openings of a first pair is different from a distance between openings of a second pair.

12. The device according to claim 8, wherein the protective layer is on the passivation layer.

13. The device according to claim 1, wherein the piezoelectric actuator has a first surface that includes the portion of the piezoelectric actuator that remains exposed by the passivation layer, wherein the protection layer is on the entire first surface of the piezoelectric actuator.

14. The device according to claim 1, wherein the passivation layer is only on side surfaces of the piezoelectric actuator.

15. A process comprising:

forming, on a first wafer, a piezoelectric actuator, wherein forming includes forming a passivation layer at least along side surfaces of the piezoelectric actuator such that a surface portion of the piezoelectric actuator remains exposed from the passivation layer, wherein forming further includes forming a protection layer directly on the surface portion of the piezoelectric actuator such that the protective layer abuts the surface portion of the piezoelectric actuator that remains exposed from the passivation layer, wherein the protective layer has a Young's modulus that is lower than the Young's modulus of the passivation layer;

coupling the first wafer to a second wafer; and forming a chamber configured to contain a fluid to be ejected.

16. The process according to claim 15, wherein forming the protection layer comprises forming an intermediate protection layer made of an organic material or made of a material with a hybrid inorganic-organic structure by spin-coating and subsequently photolithographically patterning the intermediate protection layer.

17. The process according to claim 15, wherein forming the protection layer comprises printing an organic material or a material with a hybrid inorganic-organic structure.

18. The process according to claim 15, wherein forming the passivation layer further comprises forming the passivation layer on an upper surface of the piezoelectric actuator, wherein the portion of the piezoelectric actuator that remains exposed from the passivation layer is a central portion of the upper surface.

19. A fluid ejection device, comprising:

a chamber configured to contain a fluid to be ejected;

a membrane configured to deflect toward and away from the chamber;

a piezoelectric actuator on the membrane and operatively coupled to the membrane to cause, in use, deflections of the membrane;

a passivation layer along side surfaces of the piezoelectric actuator such that at least a portion of a surface of the piezoelectric actuator remains exposed from the passivation layer; and a protection layer abutting the portion of the piezoelectric actuator that remains exposed from the passivation layer, the protective layer having a Young's modulus that is lower than a Young's modulus of the passivation layer.

20. The device according to claim 19, wherein the portion of the surface of the piezoelectric actuator that remains exposed from the passivation layer is a central portion of an electrode, wherein the protection layer abuts the central portion of the electrode.

21. The device according to claim 20, wherein the Young's modulus of the protection layer is at least 100 times less than the Young's modulus of the passivation layer.

22. The device according to claim 20, wherein the protection layer has a thickness that is at least 100 times greater than a thickness of the passivation layer.

* * * * *